US010448736B2

(12) United States Patent
Vanliefde et al.

(10) Patent No.: US 10,448,736 B2
(45) Date of Patent: Oct. 22, 2019

(54) WASHABLE MOBILE CABINET WITH DRAINAGE

(71) Applicant: Belintra, Inc., Semmerzake (BE)

(72) Inventors: Charlotte Vanliefde, Semmerzake (BE); Peter Van der Vennet, Semmerzake (BE)

(73) Assignee: BELINTRA, INC., Semmerzake (BE)

( * ) Notice: Subject to any disclaimer, the term of this patent is extended or adjusted under 35 U.S.C. 154(b) by 0 days.

(21) Appl. No.: 15/679,305

(22) Filed: Aug. 17, 2017

(65) Prior Publication Data

US 2018/0049546 A1 Feb. 22, 2018

Related U.S. Application Data

(60) Provisional application No. 62/376,196, filed on Aug. 17, 2016.

(51) Int. Cl.

| | |
|---|---|
| ***A47B 81/00*** | (2006.01) |
| ***A47B 91/00*** | (2006.01) |
| ***A47B 31/00*** | (2006.01) |
| ***A47B 47/02*** | (2006.01) |
| ***A47B 96/20*** | (2006.01) |

(52) U.S. Cl.

CPC ..... *A47B 81/00* (2013.01); *A47B 31/00* (2013.01); *A47B 91/005* (2013.01); *A47B 47/02* (2013.01); *A47B 96/20* (2013.01)

(58) Field of Classification Search

CPC ..... A47B 81/00; A47B 91/005; A47B 77/00; A47B 77/04; A47B 77/06; A47B 96/00; A47B 55/00; A47L 19/02; H02B 1/565; B65D 11/08; B65D 25/005; F16N 31/002; F16N 31/006; Y10T 137/5762; Y10T 137/5907; B62B 1/008; B62B 1/10; B62B 3/006; H05K 7/20

USPC ..... 174/17 R, 50

See application file for complete search history.

(56) References Cited

U.S. PATENT DOCUMENTS 5,018,263 A * 5/1991 Stern ..... B21D 35/00 160/371
5,159,155 A * 10/1992 Nishihara ..... H01R 13/5227 174/50
5,555,640 A * 9/1996 Ou ..... A47L 19/00 211/133.6

(Continued)

FOREIGN PATENT DOCUMENTS

DE 29718687 U1 * 12/1997 ..... H02B 1/565
EP 2147628 A2 * 1/2010 ..... A47L 19/02

*Primary Examiner* — Andrew M Roersma

(74) *Attorney, Agent, or Firm* — Westman, Champlin & Koehler, P.A.

(57) ABSTRACT

A washable cabinet and a method of manufacturing said washable cabinet are disclosed. The washable cabinet includes a base and at least two opposing side walls extending from the base. The base is provided with a longitudinal recess for collection of liquid. The longitudinal recess is disposed essentially parallel to an upper surface of the base. The base is further provided with a longitudinal trough disposed below the longitudinal recess. The longitudinal recess is disposed with one or more first apertures for drainage of liquid into the longitudinal trough. The longitudinal trough is provided with one or more second apertures for drainage of liquid to the atmosphere. The cabinet formed form a single continuous sheet of material having fold lines thereon.

17 Claims, 3 Drawing Sheets

(56) References Cited

U.S. PATENT DOCUMENTS

| | | | | |
|---|---|---|---|---|
| 5,957,555 | A * | 9/1999 | Kohler | H02B 1/30 211/26 |
| 6,102,498 | A * | 8/2000 | Kohler | H02B 1/28 312/223.1 |
| 6,238,029 | B1 * | 5/2001 | Marzec | H02B 1/30 211/26 |
| 7,028,964 | B2 * | 4/2006 | Baechle | A47B 91/005 206/320 |
| 8,317,274 | B2 * | 11/2012 | Hsiao | H05K 7/18 312/223.1 |
| 2002/0121293 | A1 * | 9/2002 | McCormick | B08B 17/00 134/42 |
| 2008/0179264 | A1 * | 7/2008 | Abrams | A47L 19/02 211/41.3 |
| 2011/0210652 | A1 * | 9/2011 | Birkenstock | H02B 1/50 312/236 |

* cited by examiner

WASHABLE MOBILE CABINET WITH DRAINAGE

CROSS REFERENCE TO RELATED APPLICATION(S)

This application claims the benefit of U.S. Provisional Patent Application Ser. No. 62/376,196 entitled WASHABLE MOBILE CABINET WITH DRAINAGE that was filed on Aug. 17, 2016, the contents of which are incorporated by reference in its entirety.

BACKGROUND

The present disclosure relates to washable cabinets. More specifically, the disclosure relates to washable cabinets provided with a longitudinal recess for collection of liquid and with a longitudinal trough disposed below the longitudinal recess.

Sterile cabinets are commonly used in hospitals for storing and transporting sterile materials. After these sterile cabinets have been used during a surgical procedure, cleaning is necessary. High throughput of the cleaning process and ensuring a sterile environment in the cabinets are two goals which are preferably achieved simultaneously. However, in typical cabinets, a trade-off exists between high throughput (also called "washability"), and sterility.

In particular, for optimum sterility, a hermetically sealed environment is desirable in the cabinet. Accordingly, microorganisms do not have any paths for entering the sterile cabinet and its sterility is ensured.

On the other hand, for optimum washability, the cabinet preferably comprises multiple perforations, especially in its base, as these perforations allow washing liquid to flow out of the washing cabinet after washing. Also, ventilation provided by perforations allows for removal of washing liquid through evaporation. However, the perforations allow ingress of microorganisms, thereby compromising the sterility of the cabinets.

SUMMARY

An aspect of the present disclosure relates to a washable cabinet comprising a base, at least two opposing side walls extending from the base and the base provided with a longitudinal recess for collection of liquid. The recess may be disposed essentially parallel to an upper surface of the base and further provided with a longitudinal trough disposed below the longitudinal recess. The longitudinal recess may be disposed with one or more first apertures for drainage of liquid into the longitudinal trough, the longitudinal trough provided with one or more second apertures for drainage of liquid from the cabinet and to the outside environment/atmosphere.

The longitudinal recess may be disposed along an outer edge of the base and adjoin a side wall. The longitudinal recess and longitudinal trough may also be mutually parallel.

The base may be provided with two longitudinal recesses each adjoining an opposing side wall. Further, the base may be provided with three longitudinal recesses each adjoining a side wall.

Another aspect of the present disclosure relates to a cabinet where the longitudinal recess and longitudinal trough may be formed from a hollow tubular member, an outside wall of the hollow tubular member forming at least part of the longitudinal recess and a void space of the hollow tubular member forming the longitudinal trough. The base, longitudinal recess and longitudinal trough may also be formed from a folded continuous sheet.

The one or more first apertures and the one or more second apertures may be mutually staggered along the longitudinal recess. The one or more second apertures may be disposed at a lower inner and/or lower outer corner of the trough.

Yet another aspect of the present disclosure relates to a method for manufacturing a washable cabinet as described herein, the method comprising providing a continuous sheet where the continuous sheet comprising a plurality of fold lines. The sheet may be provided with apertures in the continuous sheet along at least one fold line. Further, forming the cabinet comprises folding the continuous sheet along the fold lines thereby providing a base of the washable cabinet; and attaching at least two opposing side walls to the base.

DETAILED DESCRIPTION

Figure 1A:
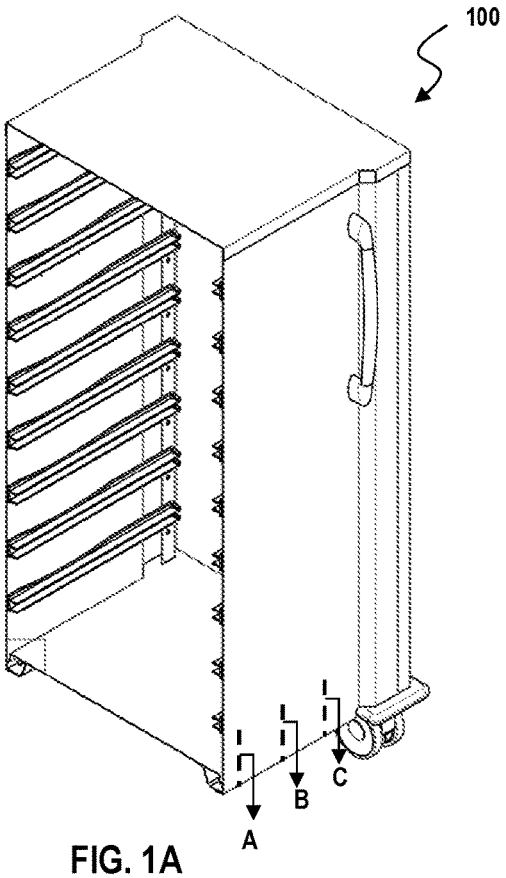
FIG. 1A is an isometric view of a washable cabinet of the present disclosure.

The present disclosure will be described with respect to particular embodiments but the disclosure is not limited thereto but only by the claims.

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional elements or method steps. The terms "comprising", "comprises" and "comprised of" when referring to elements or method steps cited herein also include embodiments which "consist of" said elements or method steps cited herein.

Furthermore, the terms first and second and the like as used herein are used for distinguishing between similar elements and not necessarily for describing a sequential or chronological order, unless specified. It is to be understood that the terms so used are interchangeable under appropriate circumstances and that the embodiments of the disclosure described herein are capable of operation in other sequences than described or illustrated herein.

The term "about" as used herein when referring to a measurable value such as a parameter, an amount, a temporal duration, and the like, is meant to encompass variations of +/−10% or less, preferably +/−5% or less, more preferably +/−1% or less, and still more preferably +/−0.1% or less of and from the specified value, insofar such variations are appropriate to perform in the disclosed disclosure. It is to be understood that the value to which the modifier "about" refers is itself also specifically, and preferably, disclosed.

The recitation of numerical ranges by endpoints includes all numbers and fractions subsumed within the respective ranges, as well as the recited endpoints.

Unless otherwise defined, all terms used in disclosing the disclosure, including technical and scientific terms, have the meaning as commonly understood by one of ordinary skill in the art to which this disclosure belongs. By means of further guidance, definitions for the terms used in the description are included to better appreciate the teaching of the present disclosure. The terms or definitions used herein are provided solely to aid in the understanding of the disclosure.

In the present description of the disclosure, reference is made to the accompanying drawings that form a part hereof, and in which are shown by way of illustration only of specific embodiments in which the disclosure may be practiced. Parenthesized or emboldened reference numerals affixed to respective elements merely exemplify the elements by way of example, with which it is not intended to limit the respective elements. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

A washable cabinet of the present disclosure is illustrated generally in the figures at 100. The washable cabinet 100 comprises a base 200 having a longitudinal recess 210 therein. At least two opposing side walls 300, 300' extend upwardly from connection with the base 200. The longitudinal recess 210 in the base 200 is configured for collection of liquid and is disposed essentially parallel to an upper surface 206 of the base 200, and may be further provided with a longitudinal trough 240 disposed below the longitudinal recess 210. The longitudinal recess 210 may be disposed with one or more first apertures 222 for drainage of liquid into the longitudinal trough 240. The longitudinal trough 210 provided with one or more second apertures 242 allows for drainage of liquid to the atmosphere.

Figure 1B:
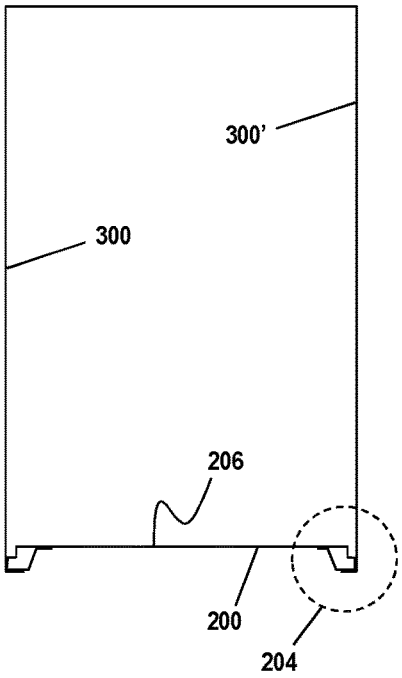
FIG. 1B is a longitudinal cross-sectional view through the cabinet of FIG. 1A showing a recess and trough of a base of the cabinet.

Referring to the embodiment illustrated in FIGS. 1A and 1B, the washable cabinet 100 comprises at least two side walls 300, 300' and the base 200. The base 200 comprises the upper base surface 206, where reference characters "A", "B" and "C" illustrate the location of cross sections through the joint between the side wall 300, 300' and the base 200. These cross sections are illustrated in detail in FIGS. 2A and 2B.

Figure 2A:
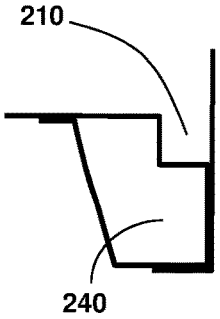
FIG. 2A is cross-sectional view of the trough and longitudinal recess with an arrangement of apertures.
Figure 2B:
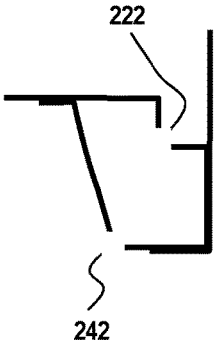
FIG. 2B is cross-sectional view of the trough and longitudinal recess with an alternative arrangement of apertures.

Referring now to FIGS. 2A and 2B, FIGS. 2A and 2B shows cross sections (A, B as shown in FIG. 1A) through the base 200 and the wall 300, 300' of the washable cabinet 100. Both cross sections A and B show the longitudinal recess 210 and trough 240 disposed below the longitudinal recess 210. In particular, below the base 200 and the longitudinal recess 210, the trough 240 is formed. The base 200, the longitudinal recess 210, and the trough 240 are formed from a single sheet of metal.

Cross-section A cuts through a solid part of the trough 240. In the solid part of the trough 240 no apertures 222, 242 are present. Cross section B cuts through a perforated part of the trough 240. In the perforated part of the trough 240, apertures 222, 242 are present. In particular, cross-section B shows how a first aperture 222 may be formed in the inner corner of the longitudinal recess 210 in the base 200, and how a second aperture 242 is formed in the lower and inner corner of the trough 240.

Figure 2C:
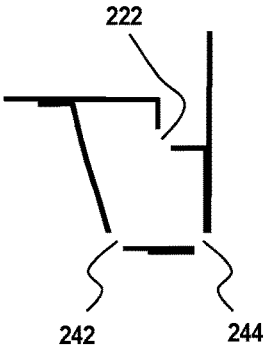
FIG. 2C is cross-sectional view of the trough and longitudinal recess with yet another alternative arrangement of apertures.

Referring now to FIG. 2C, which is a cross-section (C as shown in FIG. 1A) of an alternative configuration of the trough 240 apertures. In particular, the trough comprises second apertures 242, 244 disposed on the inside and outside corner of the trough 240. The first aperture is formed in the inner corner of the longitudinal recess 210. The second apertures 242, 244 are formed in the lower and inner corner of the trough 240 and in the lower and outer corner of the trough 240.

The washable cabinets (also referred to interchangeably throughout this disclosure as "washing" cabinets) allow fluid draining after cleaning while preventing ingress of microorganisms into the cabinet. As disclosed above, the washable cabinet 100 comprises a base 200 and at least two opposing side walls 300, 300' which extend from the base. A third side wall may extend from the base; the third side wall, which may be a back side wall, may be disposed at the back of the cabinet 100, extending from the back of the base. The third side wall is disposed between and connected to the opposing side walls. A front of the cabinet may be provided with a repeatable closure that is a door, typically a hinged door.

In further detail, the longitudinal recess 210 may be disposed along an outer edge of the base 200 and adjoining at least one side wall 300, 300'. The longitudinal trough 240 may be disposed below the longitudinal recess 210. The longitudinal recess 210 and longitudinal trough 240 may also be mutually and parallel. Essentially parallel as used throughout this disclosure refers to the angle between two directions and/or the angle between two planes being smaller than about 10°, preferably being smaller than about 1°, more preferably being 0.0°.

The base may be provided with two longitudinal recesses 210 each adjoining an opposing side wall 300, 300'. Further, the base 200 may be provided with three longitudinal recesses 210 each adjoining a side wall 300, 300' and/or back wall. The longitudinal recess 210 and longitudinal trough 240 may be formed from a hollow tubular member, an outside wall of the hollow tubular member forming at least part of the longitudinal recess 210, a void space of the hollow tubular member forming the longitudinal trough 240. The base 200, longitudinal recess 210 and longitudinal trough 240 may be formed from a folded continuous sheet 250. For example, the longitudinal recess 210, and the trough 240 are formed from a single sheet of metal. This enhances the efficiency of manufacture of the present washable cabinets. The longitudinal recess 210 and longitudinal trough 240 may be formed from a hollow tubular member. Forming the longitudinal recess and longitudinal trough may be done using a method provided hereunder. An outside wall of the hollow tubular member may forms at least part of the longitudinal recess. Also, a void space of the hollow tubular member may form the longitudinal trough.

The longitudinal recess 210 may also be disposed with one or more first apertures 222 for drainage of liquid into the longitudinal trough. The longitudinal trough 240 may also be provided with one or more second apertures 242 for drainage of liquid to the atmosphere. The one or more first apertures 222 and the one or more second apertures 242 may be mutually staggered along the longitudinal recess. The one or more second apertures 242, 244 may be disposed at a lower inner and/or lower outer corner of the trough 240. The term "inner corner" and "outer corner" are used herein refer to an "inner corner" that is a corner positioned closer to the center of the cabinet. An "outer corner" refers to a corner that is positioned closer to the outside of the cabinet.

The apertures, longitudinal recess, and the trough allow efficient water drainage while preventing or reducing ingress of microorganisms. Efficient water drainage is provided by creating a fluidic connection between the inside of the washable cabinet and the outside atmosphere. Ingress of microorganisms is prevented and/or reduced by creating a warped path through which microorganism ingress is unlikely to occur.

The term "below" as used herein refers to the relative position of longitudinal recess and trough during normal use of a cabinet. In normal use, the longitudinal recess is below the base, and the trough is below the longitudinal recess. In other words, in normal use the vertical elevation of the longitudinal recess is lower than the vertical elevation of the base, and the vertical elevation of the trough is lower than the vertical elevation of the longitudinal recess. A cross section of a washable cabinet in normal use is shown in FIG. 1.

The surface of the base 200 may be horizontal. The term "horizontal" as used herein refers to a surface plane which is typically essentially parallel to a horizontal plane. There might be a slight inclination, for instance less than about 5°, preferably less than about 2°, more preferably about 0.0°.

Alternatively, the surface of the base 200 may be at least partly inclined towards one or more of the edges of the washable cabinet. In some embodiments, the inclination is between about 5° and about 30°. This inclination enhances fluid drainage without increasing microorganism ingress.

Further, at least three, or preferably four, wheels may be attached to the base 200. This allows efficient transport of the washable cabinet.

Figure 3A:
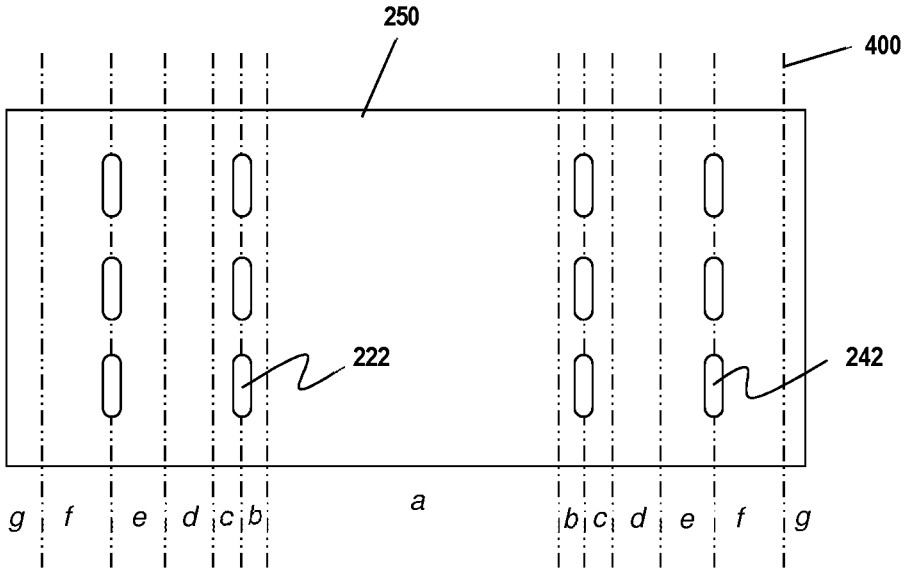
FIG. 3A is a plan view of a continuous sheet comprising fold lines, surfaces and apertures for forming the cabinet.

As noted previously, the base, longitudinal recess and longitudinal trough may all be formed from a folded continuous sheet as illustrated in FIG. 3A The longitudinal recess 240 may be disposed along an outer edge of the base 200 and adjoin a side wall. This enhances fluid drainage without increasing microorganism ingress. The trough 210 and the longitudinal recess 240 may run along the peripheral edge of the base 200. This also enhances fluid drainage without increasing microorganism ingress.

In some embodiments, the base may be provided with two longitudinal recesses each adjoining an opposing wall. This enhances fluid drainage without increasing microorganism ingress.

In some embodiments, the base may be provided with three longitudinal recesses two adjoining an opposing side walls, and one adjoining a back side wall.

In some embodiments, the longitudinal recess and longitudinal trough may be mutually parallel. In particular, a central axis of the longitudinal recess and a central axis of the longitudinal trough may be mutually parallel.

Washing liquid can be drained from the washable cabinet 100 by means of apertures. As mentioned above, the apertures may be disposed within the longitudinal recess and within the trough. This configuration of the apertures allows efficient draining of washing liquid out of the washable cabinet and into the open, e.g. into the atmosphere. Simultaneously, ingress of microorganisms is eliminated or at least minimized. The longitudinal recess is disposed with one or more first apertures 222 for drainage of liquid into the longitudinal trough, the longitudinal trough provided with one or more second apertures 242, 244 for drainage of liquid to the atmosphere.

Figure 3B:
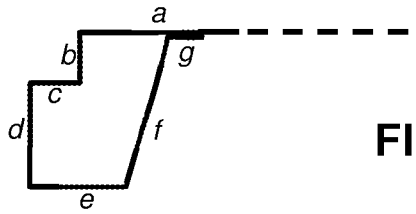
FIG. 3B is a cross-sectional view through the trough and the longitudinal recess and the surfaces (a-f) formed by the fold lines of FIG. 3A.

The first apertures 222 may be formed in the inner corner of the longitudinal recess. In some embodiments, the inner corner of the longitudinal recess corresponds to the vertex between segments b and c as illustrated in FIG. 3B. The vertex between segments b and c illustrated in FIG. 3B correspond to the fold line between segments b and c illustrated in FIG. 3A.

The second apertures 242, 244 may be formed in the lower, inner and/or outer lower corner of the trough 240. In some embodiments, the lower inner corner of the trough corresponds to the vertex between segments e and f in FIG. 3B. The vertex between segments e and f in FIG. 3B correspond to the fold line between segments e and f in FIG. 3A or FIG. 3C. It is also exemplified in FIG. 2B.

In some embodiments, the lower, outer corner of the trough corresponds to the vertex between segments d and e in FIG. 3B. The vertex between segments d and e in FIG. 3B corresponds to the fold line between segments d and e in FIG. 3A or FIG. 3C.

An exemplary embodiment of second apertures being provided at both inner and outer corners of the trough is shown in FIG. 2C, and is described in Example 3 below.

The one or more first apertures and the one or more second apertures may also be mutually staggered along the longitudinal recess 210. This reduces ingress of microorganisms in the washable cabinets without compromising their washability.

The trough 240 may comprise one or more first apertures and one or more second apertures. The one or more first apertures and the one or more second apertures may be mutually aligned in the direction of the longitudinal recess. The one or more first apertures and the one or more second apertures may be mutually staggered in the direction of the longitudinal recess.

The recitation "aligned in the direction of the longitudinal recess" as used herein refers to a configuration in which instances of a first entity (e.g. one or more second apertures) start and end at the same position in a specific spatial direction (e.g. in the longitudinal direction of a longitudinal recess and a trough, the trough being parallel to the longitudinal recess).

The term "staggered" as used herein refers to a configuration in which instances of a first entity (e.g. first apertures) alternate with instances of a second entity (e.g. second apertures) along a specific spatial direction (e.g. in the longitudinal direction of a longitudinal recess and a trough, the trough being parallel to the longitudinal recess).

In one embodiment, the cabinet is manufactured according to the following method which includes providing a continuous sheet, the continuous sheet comprising a plurality of fold lines and providing apertures in the continuous sheet along at least one fold line. Further, the cabinet is manufactured by folding the continuous sheet along the fold lines. The method may further comprise the steps of attaching at least two opposing side walls to the base.

This method allows highly efficient manufacturing of washable cabinets provided herein. In particular, the base 200, the trough 210, and the longitudinal recess 240 can all be manufactured from a single continuous sheet. Preferably, the continuous sheet is a metal sheet. In some embodiments, the continuous sheet may comprise aluminum or stainless steel.

As noted previously above, the continuous sheet used to manufacture the cabinet may comprise a plurality of apertures and preferably, the continuous sheet comprises one or more first apertures and one or more second apertures. These apertures may be located on fold lines. In particular, each class of apertures (i.e. first apertures, second apertures) are preferably located on different fold lines. However, in some embodiments, some fold lines do not have apertures located on them. In some embodiments, the apertures are aligned along the fold lines. In some embodiments, the apertures are staggered, as explained in more detail above.

Figure 3C:
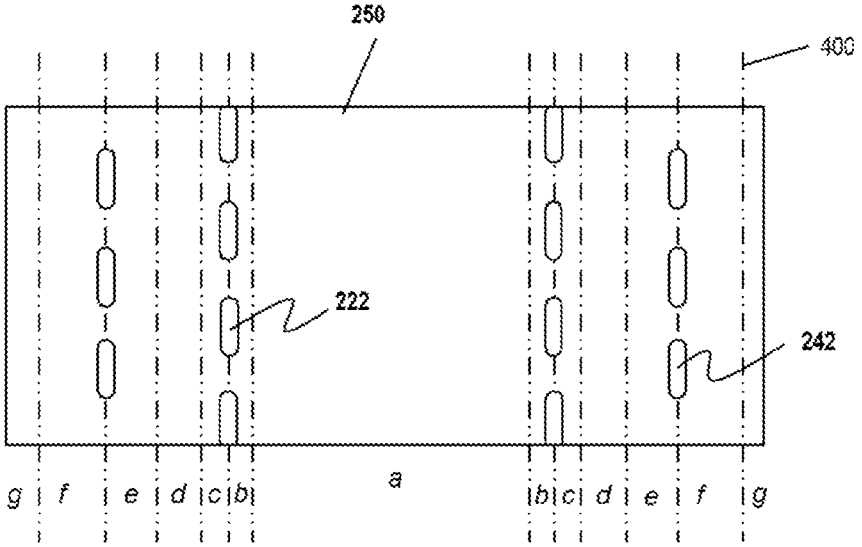
FIG. 3C is a plan view of a continuous sheet in which first apertures and second apertures are staggered.
Figure 3D:
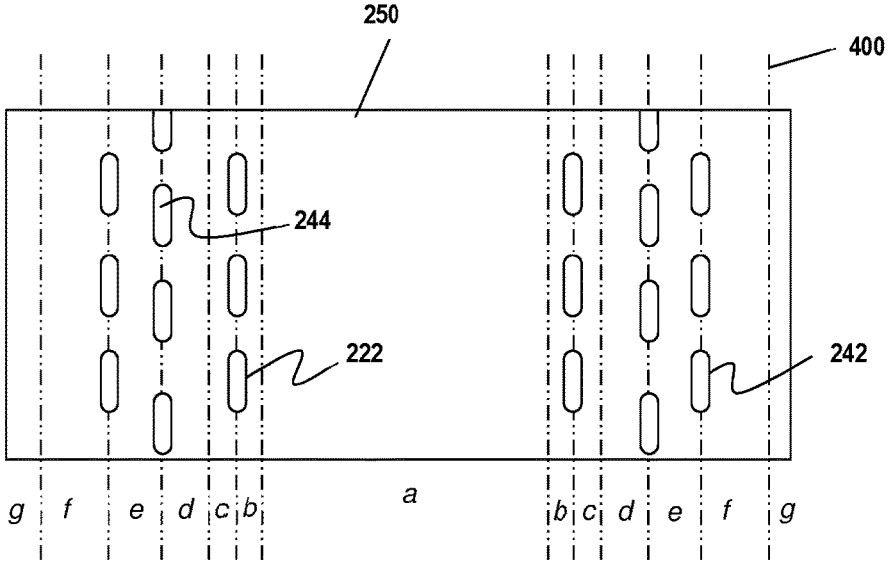
FIG. 3D is a continuous sheet in which first apertures and outside corner second apertures are staggered, and first apertures and inside corner second apertures (244) are aligned.

Referring now to the embodiment of FIGS. 3A-3D, FIGS. 3A, 3C and 3D show the continuous sheet 250. FIG. 3B shows a cross-section of the trough 240 formed by folding the continuous sheet. The continuous sheet 250 may be used for manufacturing the base 200, the trough 240, and the recess 210. Also, the continuous sheet 250 comprises multiple apertures 222, 242, the first apertures 222, and the second apertures 242, 244. The apertures 222, 242, 244 are located on fold lines 400, however some fold lines 400 do not have apertures 222, 242 located on them. In FIG. 3A, the first apertures 222 and the second apertures 242 are aligned in a longitudinal direction. In FIG. 3C, first apertures 222 and the second apertures 242 are staggered in a longitudinal direction, and the second apertures are provided between fold line e-f namely on an inside corner. In FIG. 3D, first apertures 222 and the second apertures 244 disposed on an outside corner (d-e) are staggered in a longitudinal direction, and the second apertures 242 are disposed on an inside corner (e-f) are aligned in a longitudinal direction.

In one of the process steps for manufacturing a washable cabinet provided herein, the continuous sheet 250 is folded along the fold lines 400. Accordingly, a base, recess, and trough can be formed out of a single continuous sheet 250. A cross-section of a part of a folded continuous sheet 250 is shown in FIG. 3B. By folding the continuous sheet 25) along fold lines 400, the trough is formed, wherein the sides of the trough are formed by segments (a, b, c, d, e, f, g), the segments being separated by fold lines. In the cross-section of FIG. 3B, the fold lines are shown as vertices between the segments (a, b, c, d, e, f, g).

In some embodiments, the trough is folded along six fold lines. Folding a continuous sheet along six fold lines can be sufficient for making a trough and a longitudinal recess from a single continuous sheet. Accordingly, the sides of the trough and longitudinal recess may be formed by folding along six fold lines, thereby forming seven segments, the segments being separated by fold lines. Accordingly, a piece of folded continuous sheet may be formed having a cross section shaped as an irregular hexagon, the vertexes of the hexagon corresponding to fold lines. Preferably, in the irregular hexagon thus formed, all vertices of the trough are convex and one vertex of the longitudinal recess is concave.

The sheet may be folded twelve times, wherein the folds comprise two groups of six folds, and wherein each one of the groups of six folds is folded to form a trough and a longitudinal recess as provided elsewhere herein. Accordingly, a washable cabinet which comprises two troughs and two longitudinal recesses can be formed efficiently.

Figure 4A:
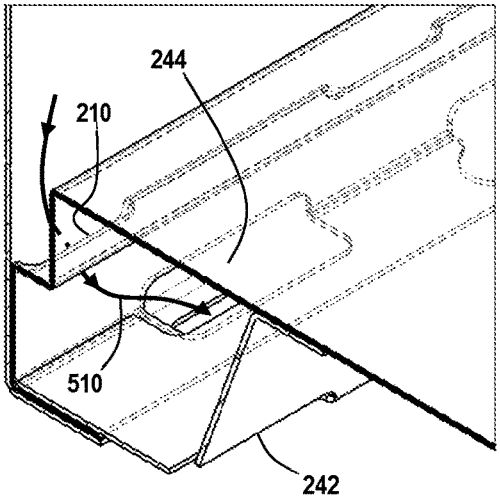
FIG. 4A illustrates path lines for the flow of fluid through apertures in the cabinet.
Figure 4B:
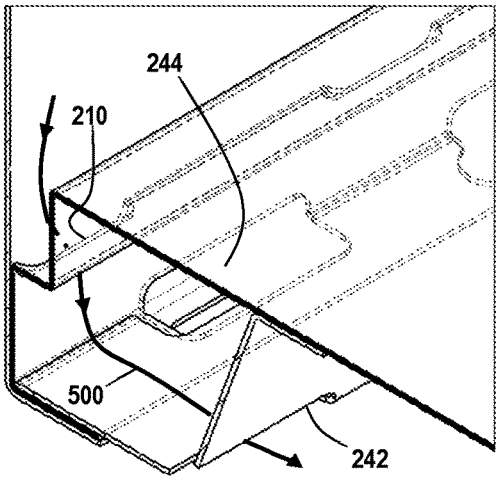
FIG. 4B illustrates path lines for the flow of fluid through apertures in the cabinet.

Referring now to FIGS. 4A and 4B, each figure refers to an embodiment of the trough and longitudinal recess as provided herein. The longitudinal recess 210 comprises a first aperture 222. The trough 240 comprises second apertures 242, 244 arranged at the respective lower inside and outside corners. The various apertures are arranged in a staggered configuration. Accordingly, most or all path lines (FIG. 4A at 500, or FIG. 4B at 510) along which airborne particles might flow into the washable cabinet are warped. In other words, there are no, or only a limited amount of, straight lines connecting the outside of the washable cabinet to the inside of the washable cabinet. This reduces and/or eliminates the ingress of airborne particles, including microorganisms, into the cabinet. Two specific path lines (500, 510) are shown in the figures. A first path line 510 flows through the first aperture 222 and an outer corner second aperture 244. A second path line 500 flows through the first aperture 222 and an inner corner second aperture 242.

Although the present disclosure has been described with reference to preferred embodiments, workers skilled in the art will recognize that changes may be made in form and detail without departing from the spirit and scope of the disclosure.

What is claimed:

1. A washable cabinet comprising:

a base having a substantially flat and impermeable upper surface;

two spaced apart side walls having a bottom edge and a top edge, the two spaced apart side walls extending from the base proximate the bottom edge;

a top wall attached to the two spaced apart side walls proximate the top edges of the two spaced apart side walls, wherein the base, the two spaced apart side walls and the top wall define an internal cavity configured to accept one or more articles to be washed within the internal cavity with a liquid;

a first longitudinal recess disposed along an outer edge of the base and below the upper surface of the base wherein the first longitudinal recess has a surface that adjoins one of the two side walls; and a longitudinal trough disposed below the first longitudinal recess;

wherein the first longitudinal recess includes one or more first apertures for drainage of the liquid from the interior cavity into the longitudinal trough and the longitudinal trough includes one or more second apertures for drainage of the liquid to the atmosphere.

2. The washable cabinet according to claim 1, wherein the surface of the longitudinal recess is substantially parallel to the upper surface of the base.

3. The washable cabinet according to claim 1, wherein the first longitudinal recess and the longitudinal trough are mutually parallel.

4. The washable cabinet according to claim 1, wherein the base is provided with the first longitudinal recess that adjoins one of the two side walls and a second longitudinal recess that adjoins another of the two side walls.

5. The washable cabinet according to claim 4, and further comprising a back wall joining the spaced apart two side walls, wherein the back wall has a bottom edge and a top edge, wherein the back wall is attached to the base proximate the bottom edge and is attached to the top wall proximate the top edge, wherein the base is provided with a third longitudinal recess adjoining a back wall.

6. The washable cabinet according to claim 1, wherein the first longitudinal recess and longitudinal trough are formed from a hollow tubular member, an outside wall of the hollow tubular member forming at least part of the first longitudinal recess, a void space of the hollow tubular member forming the first longitudinal trough.

7. The washable cabinet according to claim 6, wherein the base, the first longitudinal recess and the longitudinal trough are formed from a folded continuous sheet.

8. The washable cabinet according to claim 1, wherein the one or more first apertures and the one or more second apertures are mutually staggered along the first longitudinal recess.

9. The washable cabinet according to claim 1, wherein the one or more second apertures are disposed in at least one of a lower inner and lower outer corner of the longitudinal trough.

10. A washable cabinet comprising:

a base having a substantially planar and impermeable upper surface;

a first side wall, the first side wall having a first bottom edge and a first top edge, the first side wall extending from the base proximate the first bottom end;

a second side wall spaced from and opposing the first side wall, the second side wall the second wall having a first bottom edge and a second top edge, the second side wall extending from the base proximate the second bottom edge;

a back wall, the back wall the second wall having a third bottom edge and a third top edge, the back wall extending from the base proximate the third bottom edge, the back wall connecting the first and second side walls extending from the base;

a top wall attached to the first side wall proximate the first top edge, second side wall proximate the second top edge and the back side wall proximate the third top edge, wherein the base, the first side wall, the second side wall and the back wall define an internal cavity configured to accept one or more articles therein for washing with a liquid;

a door opposing the back wall wherein the door is movable between an open position and a closed position;

a first longitudinal recess disposed along an outer edge of the base and below the upper surface of the base and along the first side wall wherein the first longitudinal recess has a first surface that adjoins the first side wall;

a first longitudinal trough disposed below the first longitudinal recess;

a second longitudinal recess disposed along an outer edge of the base and below the upper surface of the base and along the second side wall wherein the second longitudinal recess has a second surface that adjoins the second side wall; and a second longitudinal trough disposed below the second longitudinal recess;

wherein the first and second longitudinal recesses each include one or more first apertures for drainage of the liquid into the first and second longitudinal troughs from the internal cavity and the first and second longitudinal troughs each include one or more second apertures for drainage of the liquid to the atmosphere.

11. The washable cabinet according to claim 10, wherein the upper surface of the base, the first surface of the first longitudinal recess and the second surface of the second longitudinal recess are substantially parallel.

12. The washable cabinet according to claim 10, wherein the first longitudinal recess and the first longitudinal trough are mutually parallel and wherein the second longitudinal recess and the second longitudinal trough are mutually parallel.

13. The washable cabinet according to claim 10, wherein the base is provided with a third longitudinal recess adjoining the back wall.

14. The washable cabinet according to claim 10, wherein the first longitudinal recess and the first longitudinal trough are formed from a hollow tubular member, an outside wall of the hollow tubular member forming at least part of the first longitudinal recess, a void space of the hollow tubular member forming the first longitudinal trough.

15. The washable cabinet according to claim 10, wherein the base, the first longitudinal recess, the first longitudinal trough, the second longitudinal recess and the second longitudinal trough are formed from a folded continuous sheet.

16. The washable cabinet according to claim 10, wherein the one or more first apertures and the one or more second apertures are mutually staggered.

17. The washable cabinet according to claim 10, wherein the one or more second apertures are disposed in at least one of a lower inner and lower outer corner of the first and second longitudinal troughs.

* * * * *